US010498089B2

(12) United States Patent
Li et al.

(10) Patent No.: US 10,498,089 B2
(45) Date of Patent: Dec. 3, 2019

(54) CABLE CONNECTOR ASSEMBLY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Yong-Qi Li, Kunshan (CN); Jun Chen, Kunshan (CN); Yang-Tsun Hsu, New Taipei (TW); Jerry Wu, Irvine, CA (US); Jian-Hui Tan, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/255,858

(22) Filed: Jan. 24, 2019

(65) Prior Publication Data

US 2019/0252833 A1 Aug. 15, 2019

(30) Foreign Application Priority Data

Feb. 9, 2018 (CN) ..... 2018 2 0240429 U

(51) Int. Cl.
*H01R 4/66* (2006.01)
*H01R 13/6593* (2011.01)
(Continued)

(52) U.S. Cl.
CPC ..... *H01R 13/6593* (2013.01); *H01R 12/707* (2013.01); *H01R 13/631* (2013.01);
(Continued)

(58) Field of Classification Search
CPC ..... H01R 13/4532; H01R 23/662
(Continued)

(56) References Cited

U.S. PATENT DOCUMENTS

| | | | | |
|---|---|---|---|---|
| 6,764,342 | B2 * | 7/2004 | Murayama | H01R 4/023 439/607.1 |
| 6,893,295 | B1 * | 5/2005 | Lloyd | H01R 12/772 439/607.05 |
| 2012/0090872 | A1 * | 4/2012 | Gundel | H01B 7/0861 174/102 R |

FOREIGN PATENT DOCUMENTS

| | | |
|---|---|---|
| CN | 104218394 | 12/2014 |
| CN | 105281148 | 1/2016 |

* cited by examiner

*Primary Examiner* — Phuong Chi Thi Nguyen
(74) *Attorney, Agent, or Firm* — Wei Te Chung; Ming Chieh Chang

(57) ABSTRACT

A connector assembly includes a connector and a cable electrically connected to the connector, the connector including an insulative housing, plural conductive terminals received in the insulative housing and extended in the front-rear direction, a metal shielding plate, and a grounding member fixed in the insulative housing, the conductive terminals including a tail portion exposed to a rear end of the insulative housing, the cable including a plurality of core wires, each of the core wires including an inner conductor and a metal shielding layer covering the inner conductor, wherein the grounding member is electrically connected to the metal shielding layer, the metal shielding layer of the core wires of the cable is electrically connected to the grounding member, and the inner conductor of the core wire is electrically connected to the tail portion of the corresponding conductive terminals.

11 Claims, 12 Drawing Sheets

(51) Int. Cl.

| | |
|---|---|
| ***H01R 13/631*** | (2006.01) |
| ***H01R 13/652*** | (2006.01) |
| ***H01R 12/70*** | (2011.01) |
| ***H01R 13/6589*** | (2011.01) |
| ***H01R 13/66*** | (2006.01) |
| ***H01R 13/6471*** | (2011.01) |

(52) U.S. Cl.
CPC ..... *H01R 13/6471* (2013.01); *H01R 13/652* (2013.01); *H01R 13/6589* (2013.01); *H01R 13/6658* (2013.01)

(58) Field of Classification Search
USPC ..... 439/95, 607.01, 497, 610, 143
See application file for complete search history.

CABLE CONNECTOR ASSEMBLY

BACKGROUND OF THE INVENTION

1. Field of the Invention

The present invention relates generally to a connector assembly, and more particularly to a connector assembly connecting with a cable.

2. Description of Related Arts

China Patent No. 105281148, issued on Jan. 27, 2016, discloses a connector which includes an insulative housing, an upper and lower terminal modules assembled to the insulative housing, and a shielding plate disposed between the two terminal modules. One of tail portions of the terminal modules is provided with a grounding member. The grounding member is sleeved at the tail portion of the terminal module. During the assembly process, a metal shield of the cable is soldered to the grounding member. However, the shielding plate of the connector does not realize full coverage of the front and rear directions of the two terminal modules, and the grounding member is not directly connected with the ground shielding structure, thus a better shielding and grounding effect cannot be achieved. The grounding member needs to be sleeved in the tail portion of the terminal module in advance, and both positioning and soldering between the cable and the terminal and the grounding member are required when the cable is soldered such that the assembly process is complicated and inconvenient.

Therefore, an improved connector is desired.

SUMMARY OF THE INVENTION

An object of the present invention is to provide a connector assembly with better shielding effect.

To achieve the above-mentioned object, a connector assembly comprises a connector and a cable electrically connected to the connector, the connector including an insulative housing, a plurality of conductive terminals received in the insulative housing and extended in the front-rear direction, a metal shielding plate, and a grounding member fixed in the insulative housing, the conductive terminals including a tail portion exposed to a rear end of the insulative housing, the cable including a plurality of core wires, each of the core wires includes an inner conductor and a metal shielding layer covering the inner conductor, wherein the grounding member is electrically connected to the metal shielding layer, and the metal shielding layer of the core wires of the cable is electrically connected to the grounding member, and the inner conductor of the core wire is electrically connected to the tail portion of the corresponding conductive terminals.

DETAILED DESCRIPTION OF THE PREFERRED EMBODIMENT

Figure 1:
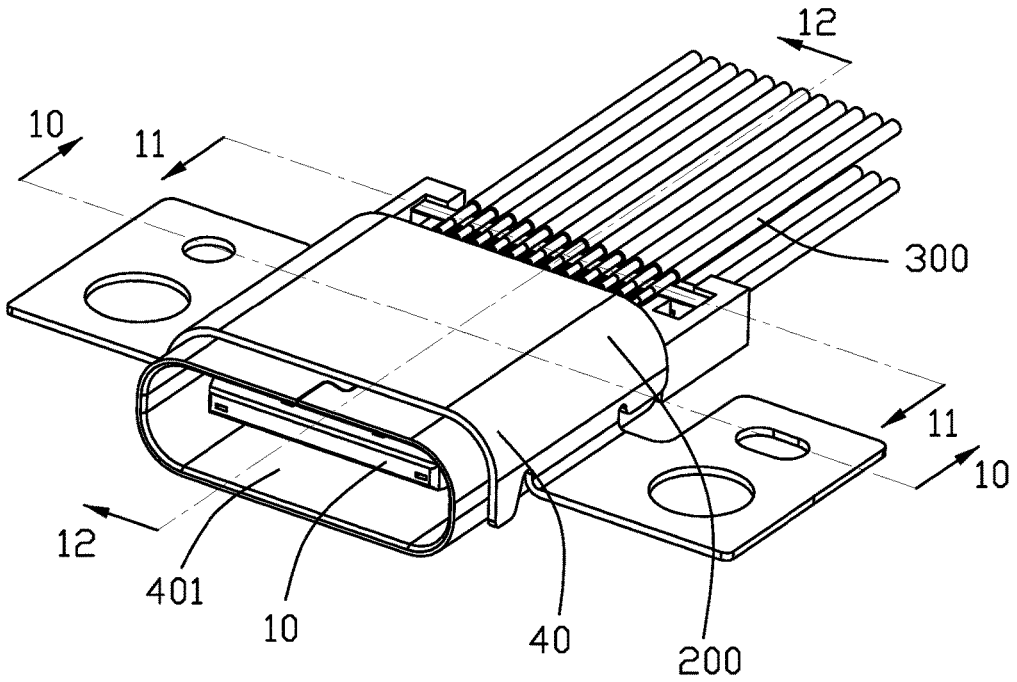
FIG. 1 is a perspective view of a connector assembly in the present invention.
Figure 2:
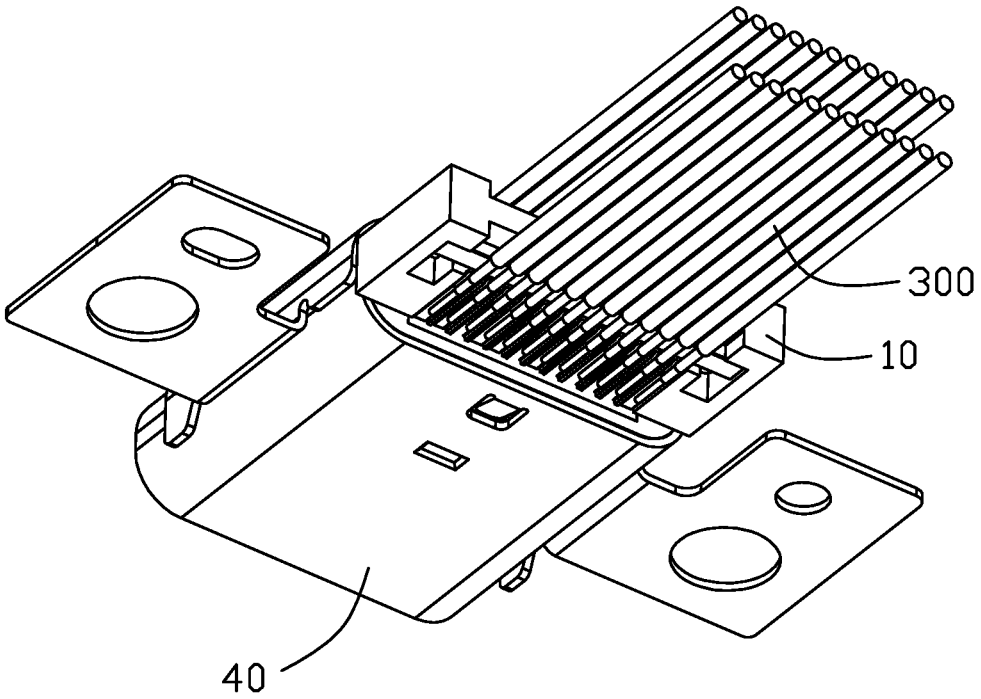
FIG. 2 is an another perspective view of the connector assembly as shown in FIG. 1.
Figure 3:
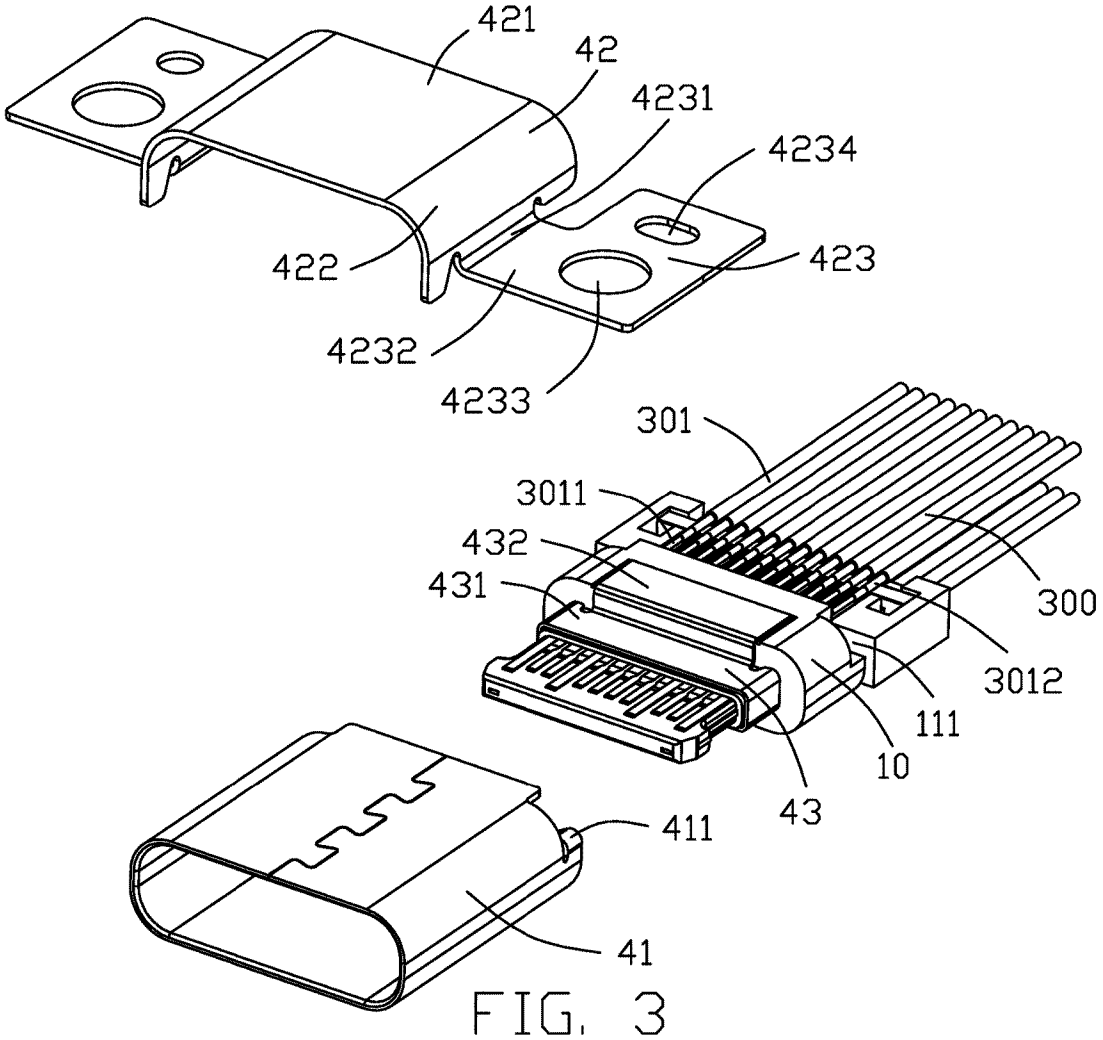
FIG. 3 is a partially exploded view of the connector assembly as shown in FIG. 1.
Figure 4:
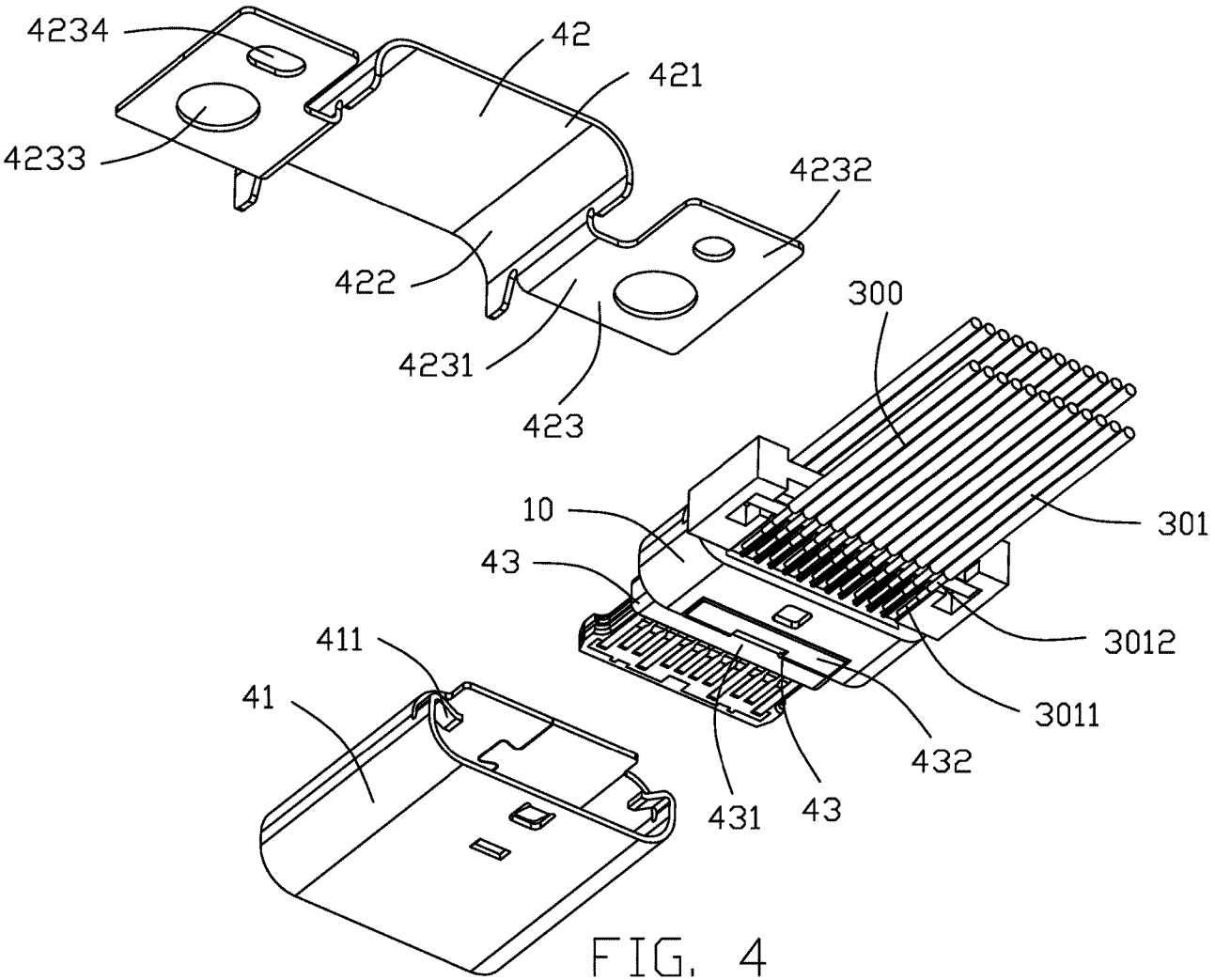
FIG. 4 is an another partially exploded view of the connector assembly as shown in FIG. 3.
Figure 5:
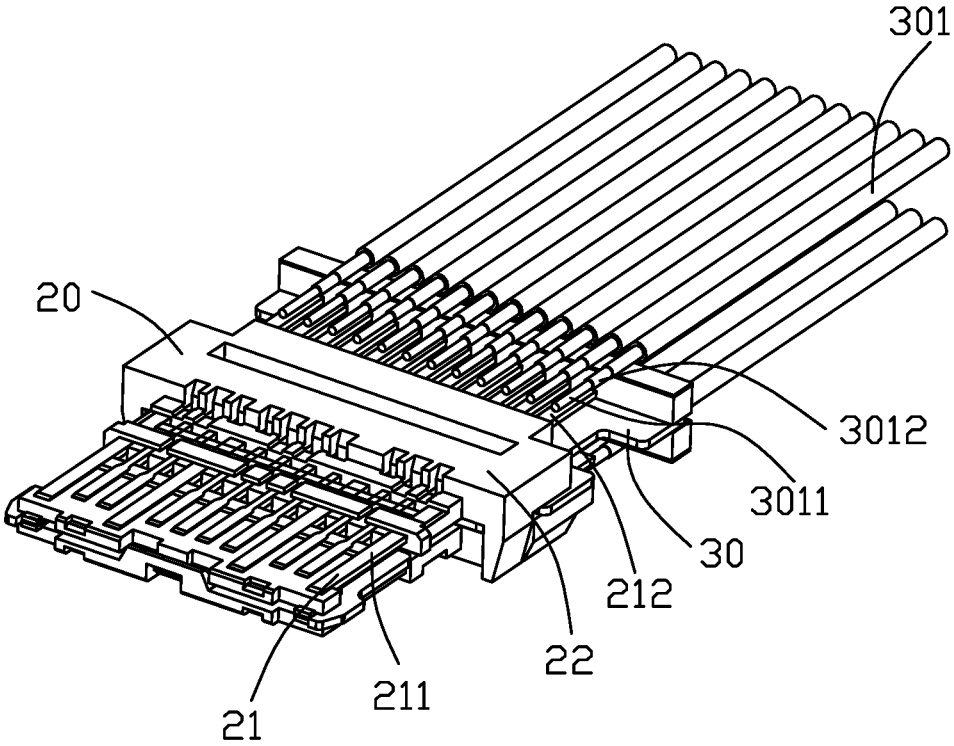
FIG. 5 is an assembled view of a terminal module and a cable.
Figure 6:
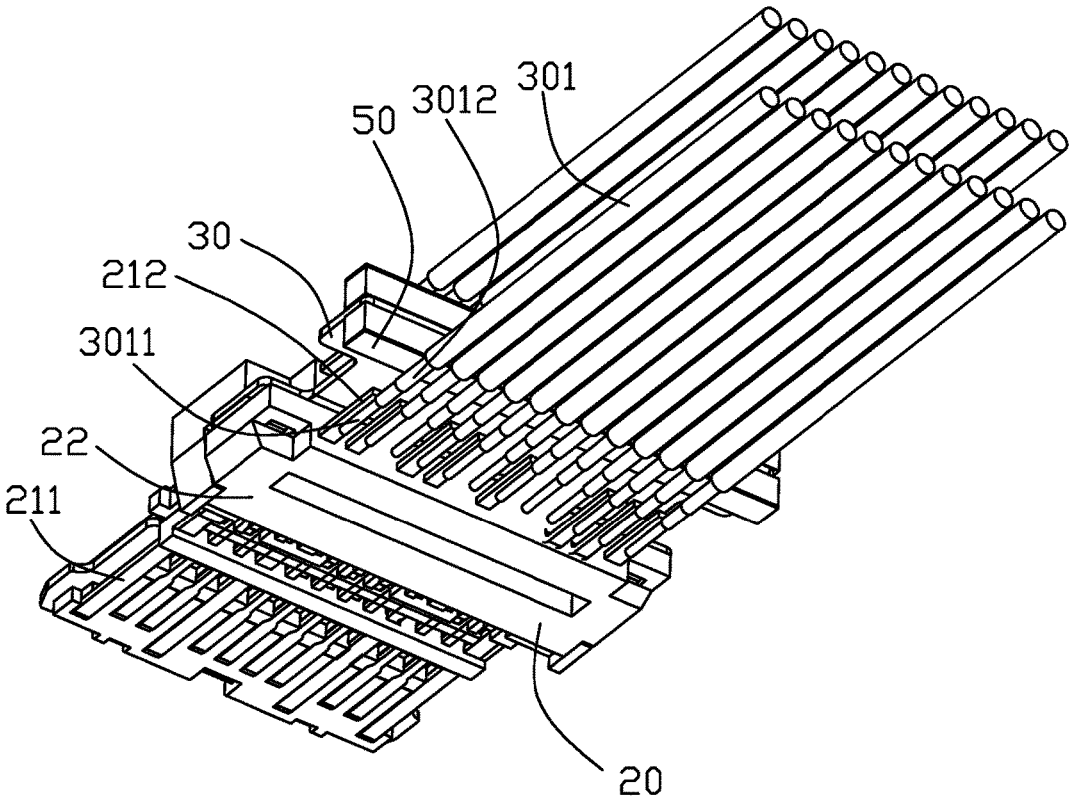
FIG. 6 is an another assembled view of the terminal module and the cable as shown in FIG. 5.
Figure 7:
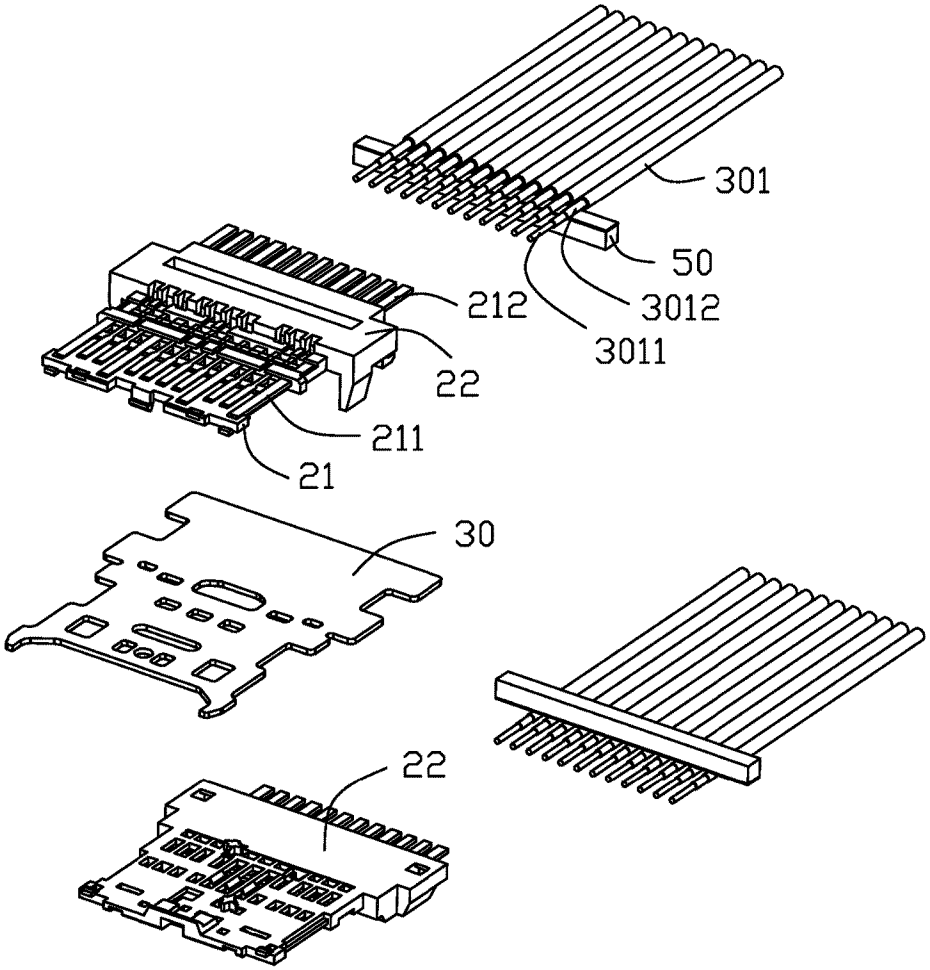
FIG. 7 is an exploded view of the terminal module and the cable as shown in FIG. 5.
Figure 8:
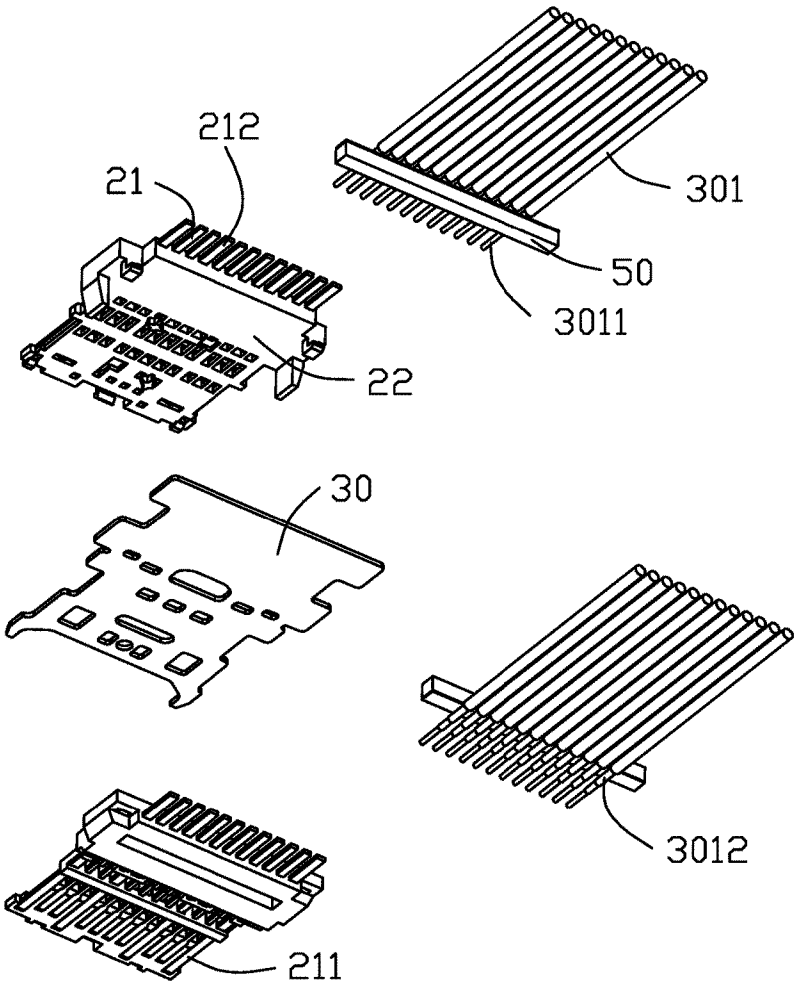
FIG. 8 is an another exploded view of the terminal module and the cable as shown in FIG. 7.

Referring to FIGS. 1 to 12, a connector assembly 100 in the present invention includes a connector 200 conforms to the USB Type C connector standard and a cable 300 connected with the connector. A preferred embodiment of the connector 200 of the present invention includes an insulative housing 10, a terminal module 20 assembled in the insulative housing 10 and soldered to the cable 300, and a metal shielding plate 30 retained in the terminal module 20. The shielding plate 30, the grounding member 50 assembled in the insulative housing 10, and the metal cage 40 covering the insulative housing 10.

The cable 300 includes a plurality of core wires 301, each of core wires 301 includes an inner conductor 3011, a metal braid layer 3012 covering the inner conductor 3011, and an insulating outer (not shown) covering the metal braid layer 3012.

The terminal module 20 includes a plurality of conductive terminals 21, and the conductive terminals 21 are arranged in two rows, which are an upper row of conductive terminals and a lower row of terminals, respectively. The terminal module 20 further includes a pair of insulators 22 integrally formed on the upper row of conductive terminals and the lower row of conductive terminals, respectively. The two insulators 22 are respectively formed and then snap-fitted in the up and down direction. Each of the conductive terminals 21 includes a contact portion 211 coated on the front end of the insulator 22 and electrically contacted with the mating connector, a holding portion (not shown) formed at the rear end of the insulator 22, and a soldered portion 212 (as a tail portion) extends beyond the rear end of the insulator 22 and soldered to the cable 300. Notably, The metal shielding plate 30 is held between the two insulators 22 of the terminal module 20 when the two insulators 22 are assembled with each other in the vertical direction. The rear end of the metal shielding plate 30 extends rearward beyond the soldered portion 212 of the conductive terminals 21.

The insulative housing 10 includes a body portion 11, a tongue portion 12 extending forward from the body portion 11, and a connecting portion 13 extending rearward from the body portion 11. The insulative housing 10 is injection molded outside/upon/behind the terminal module 20. The tongue portion 12 covers the front end portion of the insulator 22 and exposes the conductive terminals 21 to contact between the conductive terminals 21 and the mating connector. The body portion 11 covers the rear end of the insulator 22. The connecting portion 13 covers a portion of the metal shielding plate 30 exposed to a rear end of the insulator 22. The soldering portion 212 of the upper row and the lower row of conductive terminals of the terminal module 20 are respectively exposed to upper and lower sides of the connecting portion 13 to solder with the corresponding core wires 301.

Figure 9:
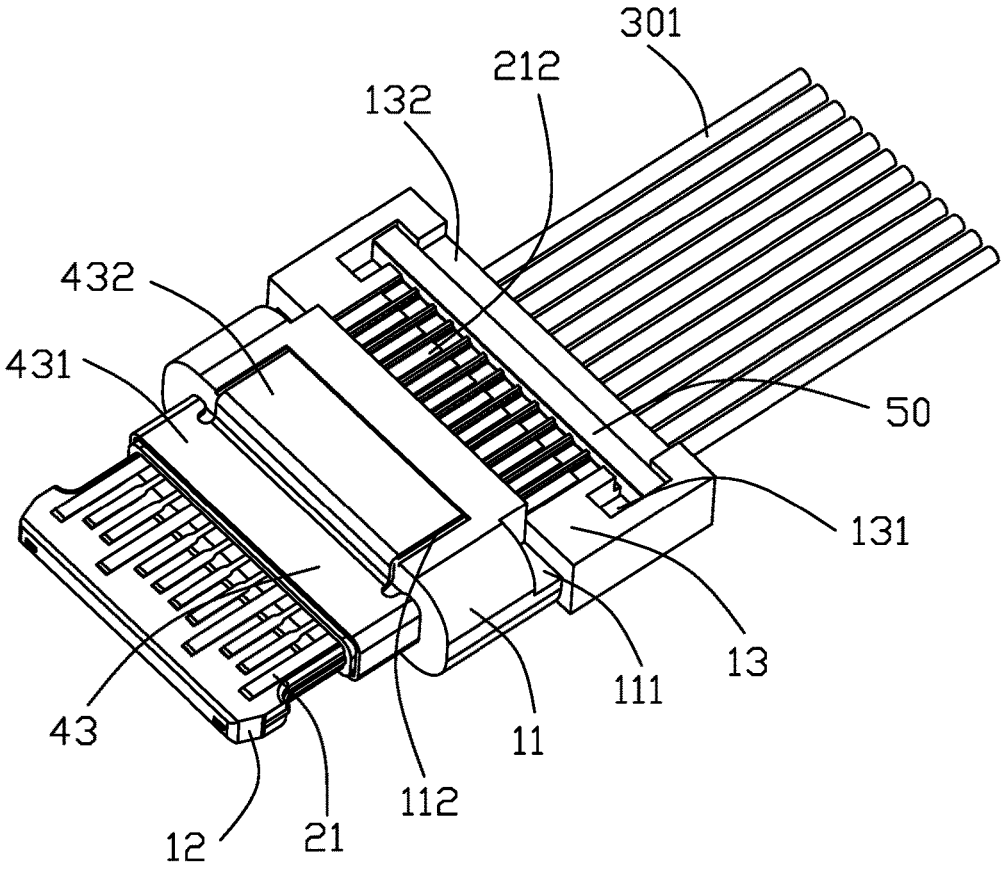
FIG. 9 is a partially exploded view of an insulative housing, the terminal module and the cable as shown in FIG. 3.
Figure 10:
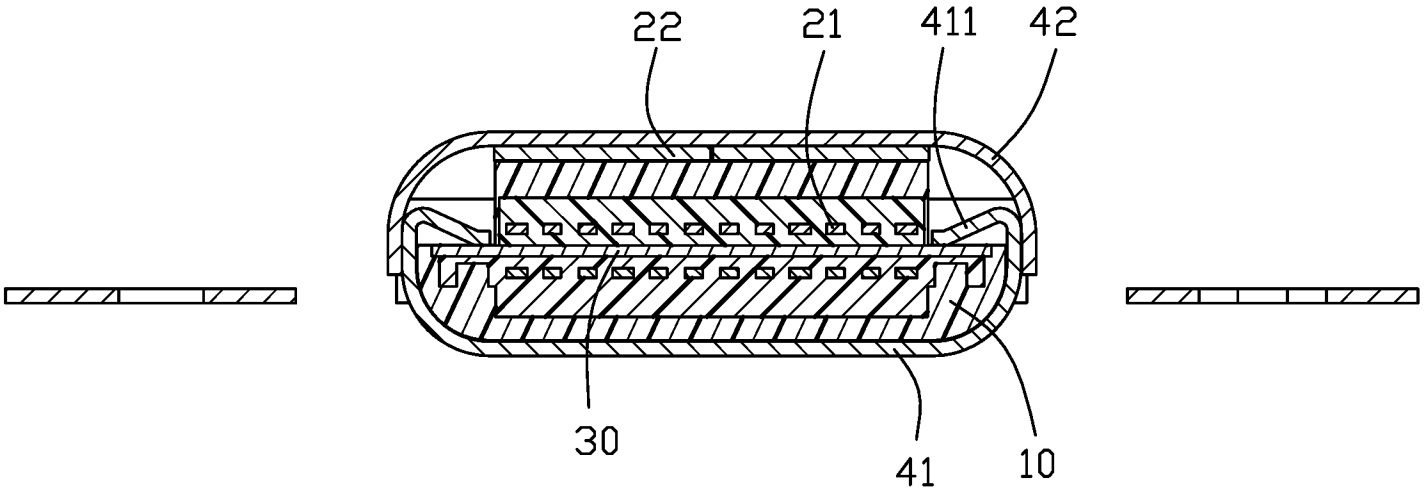
FIG. 10 is a cross-sectional view of the connector assembly taken along line 10-10 in FIG. 1.
Figure 11:
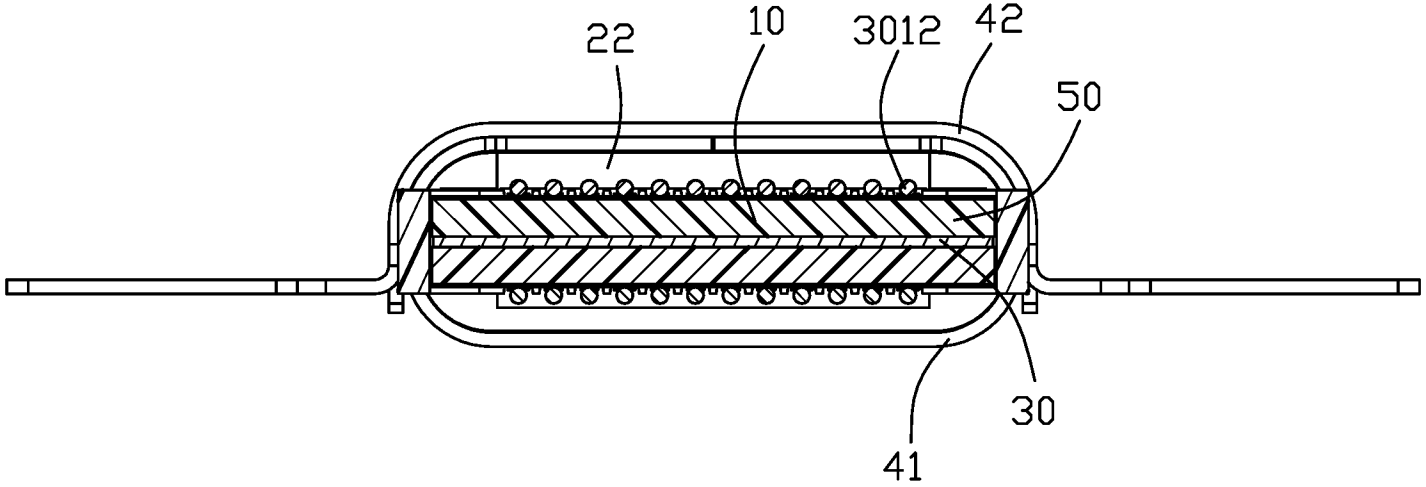
FIG. 11 is a cross-sectional view of the connector assembly taken along line 11-11 in FIG. 1.

Referring to FIG. 9, the upper and lower sides of the connecting portion 13 of the insulative housing 10 downwardly defined a rectangular strip grounding groove 131. The grounding groove 131 extends downward until the metal shielding plate 30 is exposed. The grounding member 50 is mounted in the grounding groove 131 and soldered to the metal shielding plate 30 in the grounding groove 131. The rear side of the grounding groove 131 defines a connecting slot 132. The connecting slot 132 has a depth smaller than the depth of the grounding groove 131 and penetrates the grounding groove 131. The cable 300 passes through the connecting slot 132 to achieve soldering with the conductive terminal 21 and the grounding member 50.

The left and right sides of the rear end of the body portion 11 of the insulative housing 10 includes a rectangular grounding hole 111 extends in the up and down direction until the metal shield sheet 30 is exposed. The upper and lower sides of the body portion 11 are respectively recessed into the recessed grooves 112.

The metal casing 40 is a three-piece type, and includes a ring-shaped or capsular/tubular first member 41, a second member 42 covering the top side and the left and right sides of the first member 41, and a third member 43 sleeved on the tongue portion 12 of the insulative housing 10. The third member 43 includes a closed annular covering portion 431 and an insertion portion 432 extending upward and rearward from the rear end of the top wall of the covering portion 431. The covering portion 431 conforms to the back end peripheral shape of the tongue portion 12 of the insulation body 10 to tightly cover the tongue portion 12. The insertion portion 432 is embedded in the insertion groove 112 to fix the third member 43. The first 41 conforms to the peripheral shape of the body 11 of the insulation body 10 and is coated and fixed to the body 11. The first 41 simultaneously covers the tongue plate portion 12 to form a receiving cavity 401 plugged into the docking connector. The left and right sides of the rear end of the first member 41 are bent inwardly to form a grounding leg 411. When the first member 41 is fixed to the body portion 11, the grounding leg 411 correspondingly extends into the corresponding grounding hole 111 and overlaps with the metal shielding plate 30 to form a grounding path of the metal casing 40 and the metal shielding plate 30. The second member 42 includes a top surface 421 covering the top surface of the first member 41, a side surface 422 extending downwardly from the left and right sides of the top surface 421 and a fixed wing 423 extending outward from the side 422. The side surface 422 is fastened to the left and right sides of the first member 41 to fix the second member 42 relative to the first member 41. The fixed wing 423 extends in a horizontal direction and includes a narrower extension 4231 connecting the side 422 and a wider fixing portion 4232 located outside the extension 4231. Each of the fixing portions 4232 defines a circular fixing hole 4233 and a foolproof hole 4234 on a side of the fixing hole 4233. The fixing hole 4233 is for facilitating the user to lock the connector 200 into the casing by using a fastener (for example, a screw, a screw, or the like). The foolproof hole 4232 adopts a shape other than a circle to indicate the front-rear direction of the second member 42 to facilitate assembly.

Figure 12:
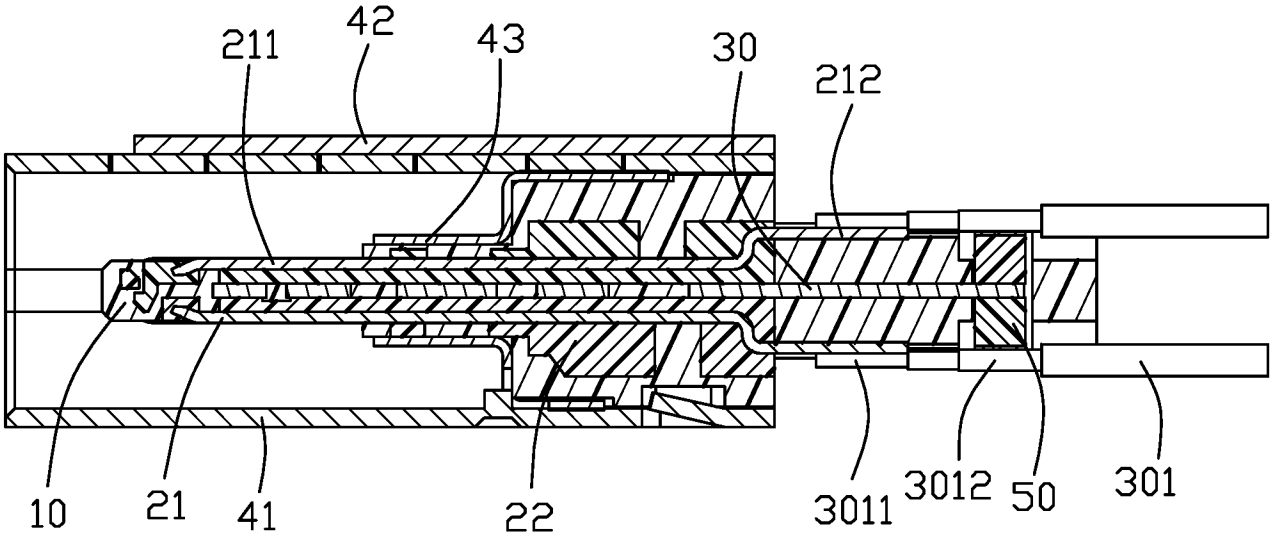
FIG. 12 is a cross-sectional view of the connector assembly taken along line 12-12 in FIG. 1.

When the connector assembly 100 of the present invention is assembled, the terminal module 20 is first formed, and the insulative housing 10 is injection molded on the outside of the terminal module 20; cutting the core wire 301 of the cable 300 to leak its inner conductor 3011 and the metal braid 3012; the core wire 301 of the cable 300 is arranged on the grounding member 50 and the braiding/shielding layer 3012 of the core wires 301 is soldered to the grounding member 50; the cable 300 connected with the grounding member 50 and soldered thereon is installed in the corresponding grounding groove 131, and soldering the grounding member 50 and the metal shielding plate 30 in the grounding groove 131, then soldering the inner conductor 3011 of the core wire 301 to the soldering portion 212 of the corresponding conductive terminals 21; the third member 43 of the metal housing 40 is embedded and fixed to the body portion 11 of the insulative housing 10; the first member 41 of the metal casing 40 is clad-fixed to the body portion 11 such that the grounding leg 411 extends into the grounding hole 111 and is overlapped with the metal shielding plate 30; the second member 42 is snap-fastened to the third member 43. In this embodiment, the connection subassembly including the terminal module 20 and the housing 10 molded thereon is forwardly assembled into the interior space of the first member 41 wherein the first member 41 forms an embossment A for preventing further forward movement of such connector subassembly, and a spring tag B for preventing backward movement of such connector subassembly as shown in FIG. 12.

The connecting portion 13 of the insulative housing 10 of the connector assembly 100 of the present invention includes the grounding groove 131 corresponding to each of the grounding members 50 to electrically solder the grounding member 50 and the metal shielding plate 30. The cable 300 is first soldered to the grounding member 50, and the positioning between the grounding member 50 and the insulative housing 10 can position between the cable 300 and the soldering portion 212 of the conductive terminal 21 to solder between the cable and the conductive terminals 21. Another feature of the invention is to have the insulative housing 10 over-molded upon the terminal module 20 to form the complete connector sub-assembly with the front full mating tongue in the tubular first member 41 of the metal casing 40, and the rear connecting portion 13 exposed outside of the metal casing 40 with the dividers C for dividing the tail portions 212 of the terminals 21 which are soldered with the inner conductors 3011 of the wires 301, and the grounding groove 131 for holding the grounding members 50 mechanically and electrically connected to both metal braiding layers 3012 of the wires 301 and the shielding plate 30.

What is claimed is:

1. A connector assembly comprising:

a connector including an insulative housing, a plurality of conductive terminals received in the insulative housing and extended in the front-rear direction, a metal shielding plate, and a grounding member fixed in the insulative housing, the plurality of conductive terminals including a tail portion exposed to a rear end of the insulative housing; and a cable electrically connected to the connector, the cable including a plurality of core wires, each of the core wires including an inner conductor and a metal shielding layer covering the inner conductor, wherein the metal shielding layer is electrically connected to the grounding member, and the inner conductor of the core wire is electrically connected to the tail portion; wherein the connector includes a metal cage, the metal cage covers the connector and is bent inward to form a grounding leg, and the grounding leg is overlapped with the metal shielding plate; wherein the metal cage includes a first member closed in a ring shape and a second member covering the top side and the left and right sides of the first member cable, the first member covers the insulative housing, the left and right sides of the second member extend outward to form a fixed wing, the fixed wing defines a circular fixing hole and a non-circular hole arranged along the front and rear direction, and the fixing hole fixes the connector to an outer casing.

2. The connector assembly as claimed in claim 1, wherein the insulative housing defines a grounding groove, and the grounding member is fixed in the grounding groove.

3. The connector assembly as claimed in claim 1, wherein the grounding groove extends into the insulative housing and exposes the metal shielding plate, and the grounding member is soldered to the metal shield plate in the grounding groove.

4. The connector assembly as claimed in claim 1, wherein the conductive terminals of the connector are arranged into two rows, the metal shielding plate is located between the two rows of conductive terminals and extends to the rear side of the soldering portion of the conductive terminals.

5. The connector assembly as claimed in claim 4, wherein the grounding member and the grounding groove are paired, the grounding grooves are respectively formed inwardly on both sides of the rear end of the insulative housing, and the cable is soldered to the outside of the two grounding members.

6. The connector assembly as claimed in claim 1, wherein the grounding member is mechanically and electrically connected to the shielding plate.

7. The connector assembly as claimed in claim 6, wherein the grounding member is sandwiched between the shielding plate and the core wires in a vertical direction electrically and mechanically.

8. A method of making an electrical connector, comprising the steps of:

providing a connector including an insulative housing, a plurality of conductive terminals received in the insulative housing and extended in the front rear direction, a metal shielding plate, and a grounding member fixed in the insulative housing, the conductive terminal including a tail portion exposed to a rear end of the insulative housing;

providing a cable including a plurality of core wires, each of the core wires including an inner conductor and a metal shielding layer covering the inner conductor;

soldering a metal shield layer of the cable to the grounding member; and soldering the inner conductor of the cable to the tail portion of the conductive terminals; wherein the insulative housing is recessed with a grounding groove, after the grounding member is mounted and fixed in the grounding groove, then the grounding member is soldered to the metal shielding plate; wherein the grounding groove extends into the insulative housing and exposes the metal shielding plate, the grounding member is soldered to the metal shield in the grounding groove; and wherein the connector further includes a metal cage covering the housing; wherein the metal cage includes a first member closed in a ring shape and a second member covering the top side and the left and right sides of the first member cable, the first member covers the insulative housing, each of the left and right sides of the second member extends outward to form a fixed wing, and the fixed wing defines a circular fixing hole for fixing the connector to an outer casing.

9. An electrical connector assembly comprising: a connector including:

a tubular capsular metallic shell;

a connector subassembly forwardly assembled into the shell from a back side of the shell, said connector subassembly including:

a terminal module having a first row of contacts integrally formed within a first insulator and a second row of contacts integrally formed within a second insulator, and a metallic shielding plate sandwiched between the first insulator and the second insulator in a vertical direction;

an insulative housing over-molded upon the terminal module to secure the first insulator, the second insulator and the shielding plate therebetween together, and including a rear connecting portion exposed outside of the shell; a cable including a plurality of wires located behind the connector, each of said wires including an inner conductor and an outer shielding layer; and a grounding member located behind the connector and soldered to corresponding outer shielding layers of the wires; wherein the connecting portion forms a plurality of dividers to separate tail portions of the contacts, respectively, for soldering to corresponding inner conductors of the wires, and the grounding member is located behind the dividers; wherein the grounding member is mechanically and electrically connected to the shielding plate; wherein the grounding member is sandwiched between the shielding plate and the wires in the vertical direction; wherein the connecting portion includes means for holding the grounding member in position; wherein the shielding plate is intimately embedded within the connecting portion in the vertical direction; wherein said shell includes a grounding legs extending into a grounding hole in the connecting portion to mechanically and electrically connect the shielding plate.

10. The electrical connector assembly as claimed in claim 9, wherein said shell further includes a spring tag engaged within a recess of the housing to prevent backward movement of the housing with regard to the shell.

11. The electrical connector assembly as claimed in claim 10, wherein said shell forms an embossment to prevent further forward movement of the housing with regard to the shell so as to cooperate with the spring tab to hold the housing and the associated terminal module in position within the shell.

* * * * *